United States Patent [19]

Catterfeld

[11] 4,060,141

[45] Nov. 29, 1977

[54] SELF-PROPELLED DEEP WELL TURBINE DRILL

[75] Inventor: Fritz C. Catterfeld, Canoga Park, Calif.

[73] Assignee: Rockwell International Corporation, El Segundo, Calif.

[21] Appl. No.: 703,042

[22] Filed: July 6, 1976

[51] Int. Cl.[2] ..... E21B 1/06

[52] U.S. Cl. ..... 175/94; 175/107; 175/344

[58] Field of Search ..... 175/94, 73, 76, 106, 175/57, 61, 99, 230, 57, 344

[56] References Cited

U.S. PATENT DOCUMENTS

| | | | |
|---|---|---|---|
| 1,790,460 | 1/1931 | Capeliuschnicoff | 175/106 |
| 2,712,920 | 7/1955 | Cullen et al. | 175/99 |
| 2,937,007 | 5/1960 | Whittle | 175/94 |
| 3,180,437 | 4/1965 | Kellner et al. | 175/99 X |
| 3,554,603 | 1/1971 | Kampf-Emden et al. | 175/99 |
| 3,797,589 | 3/1974 | Kellner et al. | 175/99 X |
| 3,888,319 | 6/1975 | Bourne, Jr. et al. | 175/94 X |

*Primary Examiner*—Ernest R. Purser
*Assistant Examiner*—Richard E. Favreau
*Attorney, Agent, or Firm*—L. Lee Humphries; Robert G. Upton

[57] ABSTRACT

A deep well drill is disclosed which utilizes as a prime mover a multistage hydraulic turbine. The system is self-propelled by means of a cylindrical clam shell assembly. The shell sections are spread apart and locked against the surrounding wall of the drilled hole by means of hydraulic cylinders. A hydraulic motor drives the turbine and drill assembly by means of a threaded shaft downward until fully extended. The clam shell is then retracted, and by reversing the hydraulic motor, follows the turbine drill downward until the start position is reached and the cycle is repeated.

8 Claims, 4 Drawing Figures

SELF-PROPELLED DEEP WELL TURBINE DRILL

BACKGROUND OF THE INVENTION

1. Field of the Invention

This invention relates to the field of oil well drilling. More specifically, this invention relates to a means to drill an oil well shaft by utilizing hydraulic turbines in combination with a clam shell arrangement to self-propel the drill.

2. Description of the Prior Art

Conventional drilling apparatus utilizes long shafts or drill strings which are subject to whipping and attendant wear and friction between shaft and hole; this, coupled with viscous fluid drag (increasing as the hole gets deeper) on the drill string, can result in bottom hole power loses up to 90%. The great losses in transmitting power characteristic of the conventional drilling system result mainly from the friction between the pipe and the hole and the viscosity of the drilling fluid. Rotating speed is limited due to whipping of the drill string; torque is limited to the dynamic torsional strength of the drill pipe.

Turbine drilling has been known since the late 1800s. However, successful turbine drilling did not occur until the late 1940s and early 1950s. Russia has developed a turbine drill over the years and currently drill 80% of their wells with this type of system. The Russian turbodrill, however, is disadvantaged in that the driving force for the turbine drill is the drill pipe stem or casing pipe which lines the hole made by the turbine drill. If the need should arise to remove the turbine drill then all of the drive string must be removed before the turbine can be removed. Conventional turbodrilling units then are not independent of the pipe stem utilized to force the turbodrill down into the well. Another disadvantage is the inability to provide instrumentation necessary to evaluate the soil conditions, rock formations, etc., because of the need for the drill string to be attached to the turbodrill. The turbodrill of the present invention being self-propelled without the utilization of a drill string allows for instrumentation to monitor the conditions of the drilled hole. Another advantage of the self-contained unit of the present invention is the ability to quickly remove the turbine drill unit from the well hole without the need to remove hundreds of feet of drill string.

While turbine drilling has been known for years, no one heretofore has attempted to operate a self-propelled turbine drill without the use of a drill or casing pipe to provide the driving force for the turbine drill.

SUMMARY OF THE INVENTION

A method for drilling well holes utilizing a self-propelled turbine drill comprising the steps of clamping a first end against a well casing wall, the first end being opposite to the turbine drill, driving a cutter head assembly at a second end deeper into the well hole by extending the cutter head assembly axially from the clamped first end, releasing the clamped first end when the cutter head assembly is extended axially into the hole to its maximum length, retracting the released first end towards the cutter head assembly, subsequently reclamping the first end and initiating another turbine drill cycle thereby advancing the drill deeper into the hole, clamping the cutter head assembly at the second end near the end of the hole while the released first end is being retracted toward the cutter head assembly to prevent reversing the direction of the cutter head in the event the first end becomes jammed against the casing wall, and subsequently releasing the clamped cutter head when the released first end is fully retracted and reclamped to the casing wall prior to initiation of another drill cycle.

The self-propelled deep well turbine drill utilizes as a prime mover a multi-stage hydraulic turbine. The turbine, for example, is a four-stage radial inflow turbine where all rotors operate in parallel and at the same pressure ratio. An arrangement of four pressure manifolds fed by two inlet pipes 180° apart supply the flow to respective nozzle banks to the turbine rotors. The turbine with bearings and seals is self-contained within the turbine unit.

The turbine is coupled to, for example, a speed reduction gearbox with a 30:1 speed reduction. The gearbox is self-contained and sealed against the environment. Fluid leaving the turbine downstream of the turbine is used to cool the gearbox by flowing the fluid between the outer cylinder wall of the turbine unit and the gearcase housing.

Connected to the gearbox is a bearing housing which is additionally self-contained and is detachable with the drill bit for ease of installation. The thrust load generated by the driving power of the axial turbine propulsion unit is reacted by an arrangement of, for example, two spherical rotor thrust bearings in combination with a large ball bearing for radial load control. The bearing housing contains the oil supply and the bearings are lubricated by, for example, internal recirculation. The bearing housing is cooled by fluid from the turbine passing through the bearing housing shaft into the cutter head and by the flow moving from the drill head upwards past the drill unit.

An underreamer section is, for example, positioned between the throat bearing housing and the cutter head. Underreamers are used to enlarge sections of the hole below the surface. They do this by expandable cutting arms which normally are collapsed in the tool body while running the turbine drill in the hole. The underreamer apparatus provides clearance for running casing, provides annular space for cementing, etc. A new use of the underreamer is disclosed in the present invention whereby the limit of expansion is enlarged to permit the expanders to press against or imbed themselves into the wall of the hole to lock the cutter head near the bottom of the hole while the retracted clam shells are drawn deeper in the hole by the threaded drive screw. The locking feature prevents the cutter head from lifting off the bottom of the hole in a reverse direction in the event the clam shells become jammed in the hole.

The turbine gear reduction box, bearing and underreamer section with attached drill cutter head is self-propelled. Upstream of the turbine is an apparatus which includes expanding clam shells and the base of the turbine unit. A rotary hydraulic motor with a hollow threaded spindle rotates and moves the threaded shaft which is affixed to the base of the hydraulic turbine housing.

The drill propelling unit operates in the following manner: The threaded shaft in the retracted position positions the turbine unit with attached cutter head against the clam shell apparatus. Hydraulic pistons force the clam shells agaist the walls of the drilled hole. The rotary hydraulic motor is then actuated and moves the threaded shaft affixed to the hydraulic turbine housing downward until it reaches its maximum extension.

When the cutter head reaches its maximum extension controlled by the length of the threaded shaft, the clam shells are retracted. The cutting arms in the underreamer section are then extended out beyond the diameter of the casing hole to engage the side walls of the hole so that when the extended clam shells are retracted the cutting head assembly will be firmly anchored near the bottom of the hole as heretofore described.

The self-propelled drilling unit is manipulated by automatic signal wherein the hydraulic clam shell actuators are retracted and the hydraulic rotary motor is reversed causing the propelling unit to follow the drill unit until it contacts with the base of the turbine housing after which the cycle is repeated.

Therefore, it is an object of this invention to provide a self-propelled deep well turbine drill unit without the need for a drill stem or string which is utilized to provide the driving force for conventional turbine drill units.

More specifically, it is an object of this invention to provide a self-propelled deep well turbine drill which utilizes an arrangement of expanding clam shells and a threaded shaft which provides an anchor for a turbine drill unit while the drill is being driven by the threaded shaft through a hydraulic means deeper into the well hole.

An advantage over the prior art is the ability to drive the turbine drill unit into a hole without the use of drill pipe for a turbine drill drive unit.

Yet another advantage over the prior art is the ability to retract the self-propelled deep well turbine drill without first removing hundreds of feet of drill pipe.

Still another advantage over the prior art is the ability to incorporate various drill hole parameter instrumentation coupled with the self-propelled deep well turbine drill to monitor the various formations as the turbine is driven deeper in the hole.

The above-noted objects and advantages of the present invention will be more fully understood upon a study of the following detailed description in conjunction with the detailed drawings.

DESCRIPTION OF THE PREFERRED EMBODIMENTS

Figure 1:
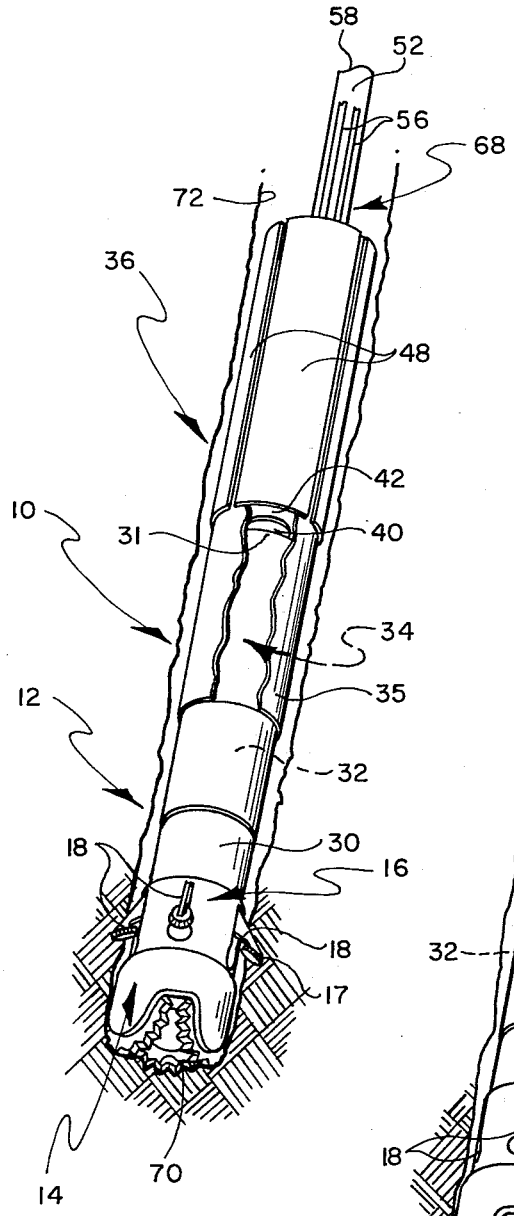
FIG. 1 is a partially cut away perspective view of the self-propelled drill unit in the retracted position with the expanding clam shell arrangement also retracted.

Turning now to FIG. 1, self-propelled deep well turbine drill generally designated as 10 consists of a turbine drill cutter assembly generally designated as 12 and a self-propelling device generally designated as 36. The turbine cutter assembly 12 comprises a cutter head 14, an underreamer section generally designated as 16, a thrust bearing 30, a gear reduction unit 32, and a four-stage turbine generally designated as 34. The turbine drill cutter assembly is propelled into the well hole 68 by a self-propelling device generally designated as 36, the device comprises an inner cylinder casing or housing 38 with, for example, four expandable type clam shell sections 48 equidistantly spaced around the inner cylinder 38, each clam shell section being actuatable by, for example, hydraulic cylinders and pistons which coact within cylinder 38 as described in more detail in FIG. 4.

Figure 2:
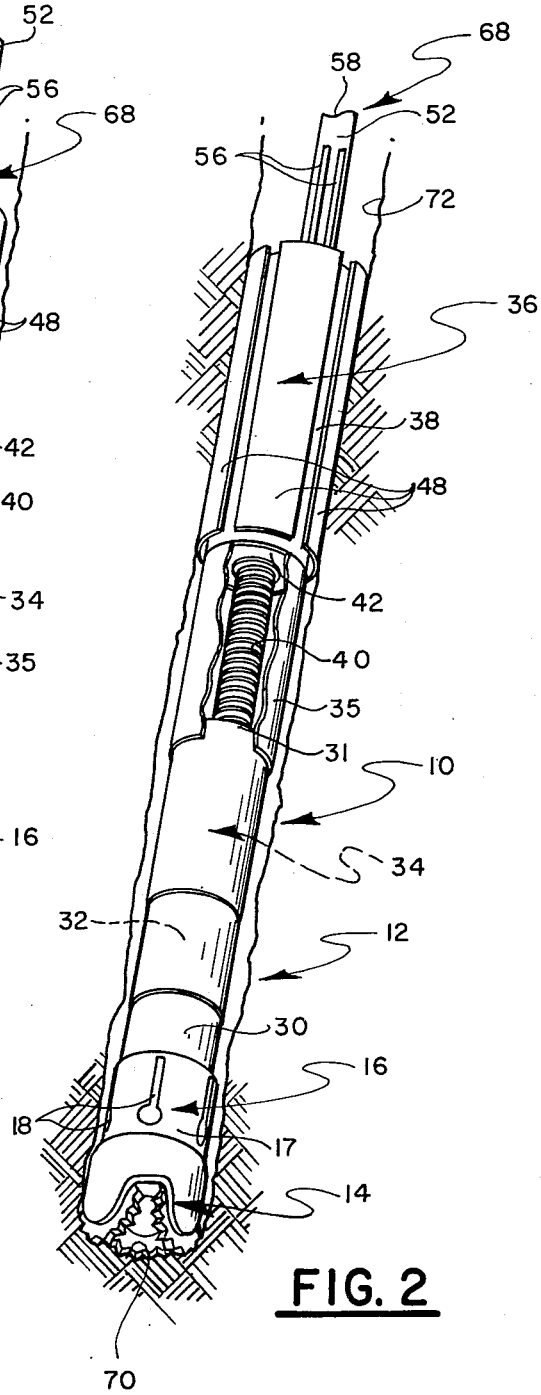
FIG. 2 is a partially cut away perspective view of the drilling unit with the drill head being in its fully-extended position with the clam shell arrangement being expanded against the walls of the drilled hole.

The self-propelling device 36 operates in the following manner: With reference to FIG. 2, the clam shell segments 48 are expanded out against the well casing walls 72 by the aforementioned hydraulic pistons. A threaded drive shaft 40 is actuated by a reversable hydraulic motor 42 which drives the threaded screw downward. The end of the drive screw is connected to base 31 of the turbine generally designated as 34. Thus, it can be seen that as the hydraulic motor rotates around the fixed threaded shaft the shaft is driven downwardly towards the bottom of the hole 70. When the turbine drive cutter assembly 12 is propelled into the hole the maximum length of the threaded drive shaft 40, the clam shell segments 48 are retracted by hydraulic pistons 53 (FIG. 4) and the hydraulic motor 40 is reversed, thus allowing the self-propelling device 36 to follow the cutter head 14 deeper into the well hole 68. When the retracted clam shell members 48 are pulled down into the hole the length of the threaded shaft the clam shell segments are then re-expanded against the casing wall 72 so that the drill cycle may be repeated. A protective sleeve 35 slides over the outer wall of the turbine thereby protecting the threads of shaft 40 from contamination.

The underreamer section generally designated as 16 serves a dual function. Normally, an underreamer for conventional well drilling devices serves to ream out the well hole 68 to accommodate a wall casing pipe which is slid down over the drilling apparatus. Arms 18 are extended out to the desired diameter to accommodate the casing pipe. The cutting arms 18 of the underreamer 16 may be extended out a greater distance so that the arms may embed themselves into the casing wall during the retraction process. For example, the clam shell segments 48 are retracted and the drive shaft 40 is caused to pull down the propelling segment 36 by the hydraulic reversable motor 42 so that in the event the clam shell segments 48 should become jammed within the well hole 68 the cutter head 14 will not be moved away from the bottom 70 of the well hole 68. When the clam shell segments are re-expanded and locked against the casing wall 72 the expandable cutting arms 18 and the underreamer section are retracted and a normal well drilling cycle is commenced.

Well drilling "mud" is pumped through mud pipe 52 at end 58, the "mud" or fluid is directed through the interior 41 (FIG. 4) down through the turbine unit 34 around the gear reduction box 32 back into the cutter head drive shaft 26 (FIG. 3) and out through the cutter head 14 at the bottom of 70 of hole 68.

Figure 3:
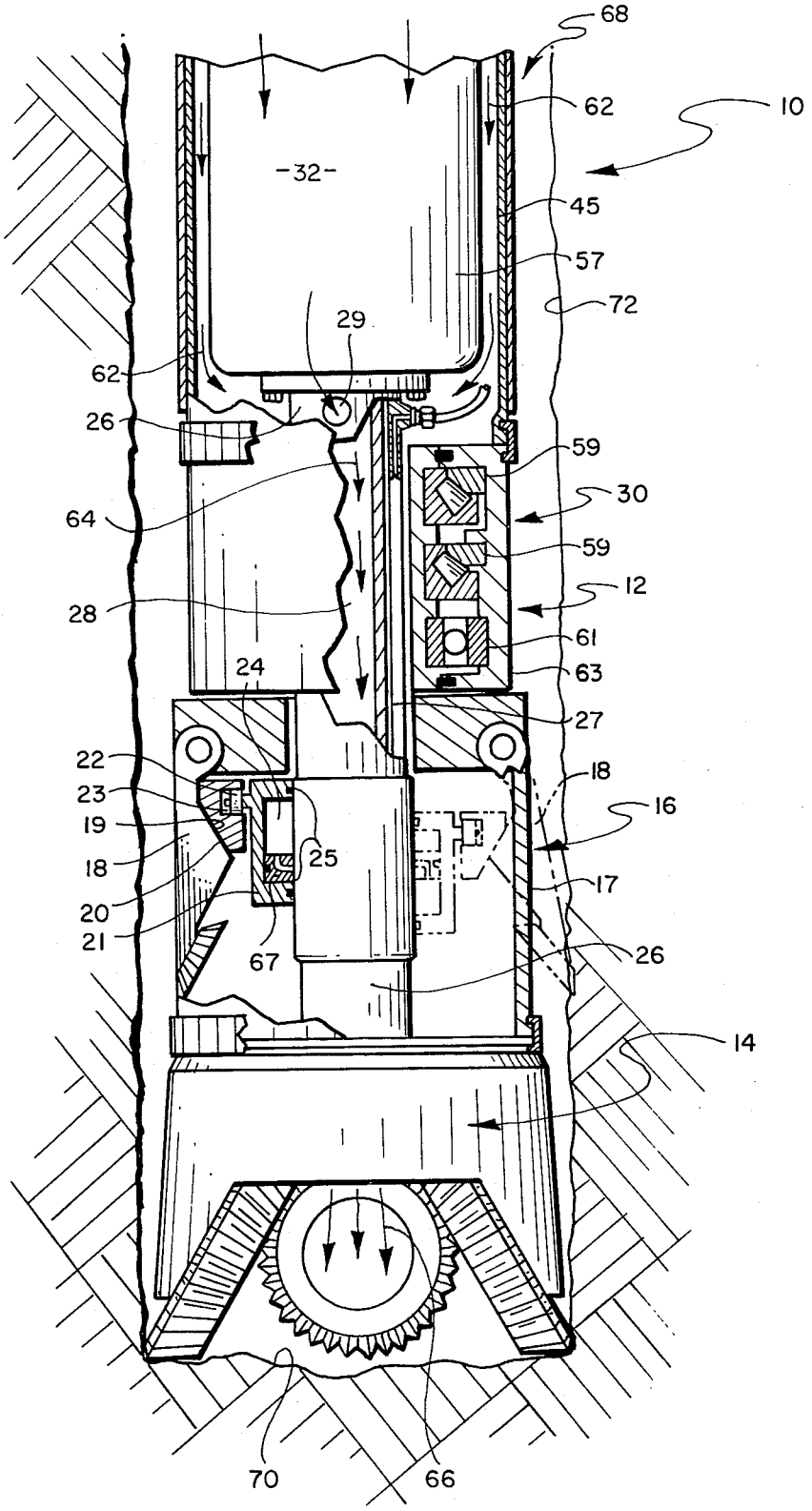
FIG. 3 is a cross-sectional view of a portion of the cutter head assembly.
Figure 4:
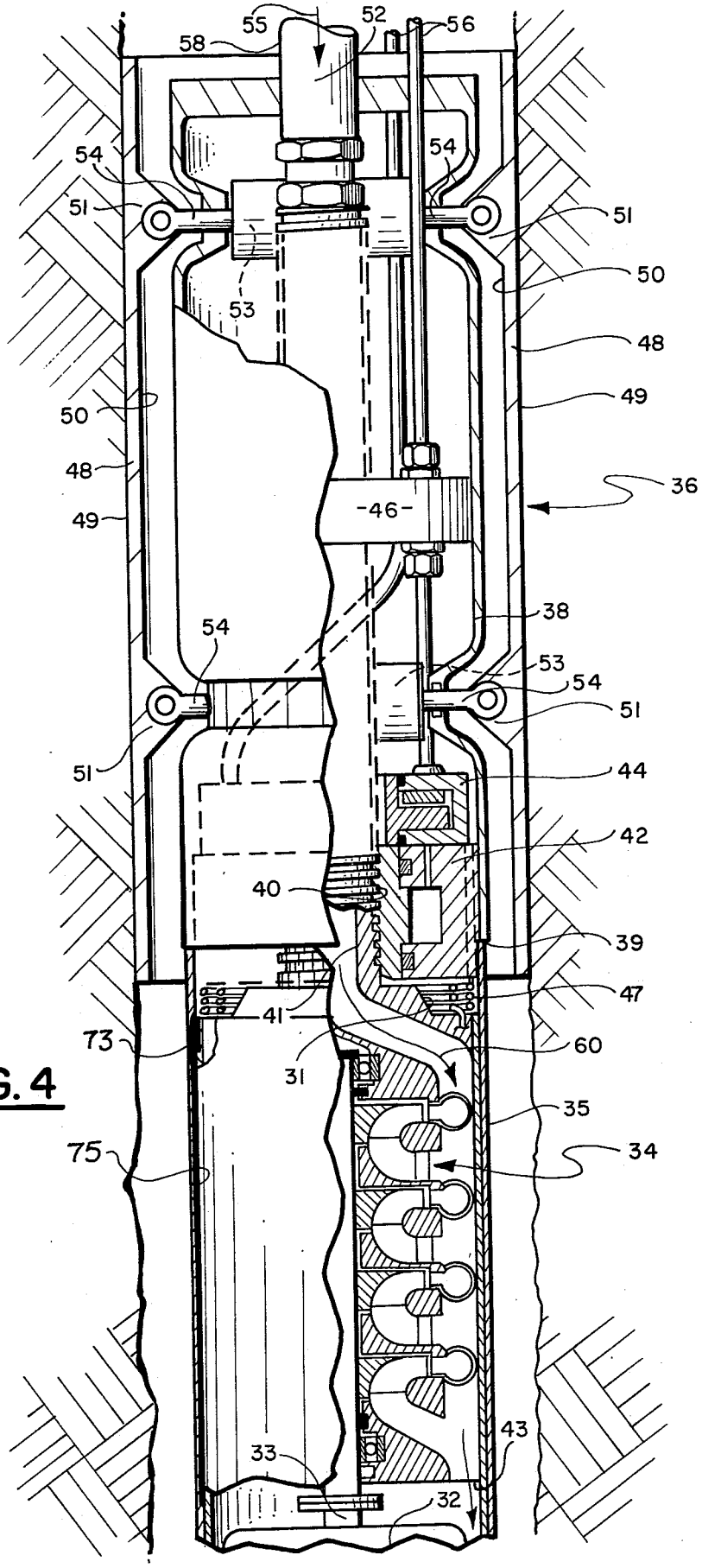
FIG. 4 is a cross-sectional view of the four-stage turbine and the clam shell propelling apparatus.

Turning to FIGS. 3 and 4, the turbine drill cutter assembly 12 is attached to the threaded drive shaft 40 at base 31. The turbine 34 is, for example, a four-stage radial inflow turbine wherein all rotors operate in parallel and at the same pressure ratio. An arrangement of four pressure manifolds fed by two inlet pipes 180° apart (not shown), supply the flow through respective nozzle banks to the turbine rotors. An axial flow turbine with four stages could also be used with only one inlet manifold. The turbine with bearings and seals is a self-contained unit. For example, it is estimated that with an available inlet pressure of 700 psi and a pressure ratio across the turbine of 10, the available power to the cutter head will be approximately 150 h.p. The turbine drive shaft 33 is connected to the speed reduction gearbox 32. The foregoing performance would be with, for example, a turbine rotor approximately 6 inches in diameter which rotates at about 3000 rpm at full torque output at a flow of about 600 gallons per minute.

The gearbox 32 is designed, for example, for a 30:1 speed reduction. The gearbox is self-contained and sealed against the surrounding environment. The fluid leaving the turbine at exit 43 is used to cool the gearbox 32 by flowing between the outer sleeve 45 and the gearbox housing 57 of gearbox 32. The thrust bearing generally designated as 30 downstream of the gearbox 32 is also a self-contained unit that is detachable with the underreamer section generally designated as 16 and the cutter head 14 for ease of installation. The thrust load generated by the driving power of the self-propelling device or axial propulsion unit 36 is reacted by an arrangement of two spherical rotor thrust bearings 59 in series with a large ball bearing 61 for radial load control. The bearing housing, for example, contains the needed oil supply and the bearings are lubricated by internal recirculation. The bearing housing 63 is cooled by fluid from the turbine exhaust through passage 43 passing through the bearing housing shaft 26 through opening 29 into the cutter head 14 and by the flow moving from the drill head upwards through well head 68. The thrust bearing unit is designed to completely absorb rotational loads within the bearing assembly without influencing the gear case 32 or the hydraulic turbine generally designated as 34. The axial load is passed from the outer bearing housing 63 to the outer housing cylinder 45 and transferred through the propelling spindle into the hydraulic rotary motor 32 which also contains a large Kingsbury-type thrust bearing 44. Rotational load from the turbine unit 10 is reacted with a key 73 and slot 75 arrangement between the turbine unit and protective sleeve 35.

Referring specifically to FIG. 4, the self-propelling device 36 becomes operable, of course, after the unit is below the surface. An arrangement of hydraulically actuated expanding shells 48 positions the drill unit in an axially fixed position. A rotary hydraulic motor 42 with a hollow threaded spindle 40 rotates (in either direction) and moves the threaded shaft 40 which is fixed to the hydraulic turbine housing at end of base 31, downward until it reaches its maximum extension. By automatic signal (not shown) the hydraulic shell actuators 53 are retracted and the hydraulic motor 42 is reversed causing the propelling unit 36 to follow the turbine drill cutter as heretofore described.

The hydraulic clam shell piston actuators 53 may be, for example, double acting pistons wherein the inner faces of the pair of pistons is subjected to pressure thus forcing the pistons outwardly, the pistons being connected by rod 54 to pads 51 affixed to surface 50 of the clam shell segments 48, thereby forcing surface 49 against the casing wall 72 of hole 68. Of course, the pair of pistons (not shown) cause the clam shell segments 48 to be retracted by exhausting hydraulic fluid out of the center between the inner faces of pistons and forcing hydraulic fluid to the outer faces of the pistons, thereby driving the pair of pistons toward each other, thus retracting clam shell segments 48.

It would be obvious to provide three clam shell members equidistantly spaced around inner cylinder 38. For example purposes only, there are described four clam shell segments 48 each segment being attached to a pair of piston actuators 53.

Hydraulic fluid is provided through hydraulic lines 56 into a hydraulic servo valve and instrumentation box generally designated as 46. The instrumentation box routes hydraulic fluid to the hydraulic motor 42 and also to the underreamer section 16 through coiled conduit 47. The coiled conduit 47 is so configured so that when the self-propelling device is clamped against the casing wall 72 of hole 68 and the threaded drive shaft 40 is at its fullest extension, the coils accommodate for the variation of distance between base 31 of turbine 34 and the bottom of the hydraulic motor 42. Hydraulic fluid is directed to the underreamer section 16 into hydraulic passage 27 which directs fluid to the annular chamber 24 of the annular hydraulic piston 21. The instrumentation package 46 controls the amount and pressure of hydraulic fluid directed to chamber 24 through manifold 67 which controls the actuation of piston 21 to extend or retract the cutter arms 18. Bearings 22 are connected to, for example, four shafts that are equidistantly spaced around and radially extend from piston 21. The bearings 22 are interfitted within recess 23 of drive ring 20 and serve as a flexible transition member while underreamer arms are being extended radially outwardly.

The rotor tip speed of the hydraulic turbine rotor 34 for the deep well drill 10 is about 78 feet per second, which is well within the state of the art of conventional pumps.

It would be obvious to redirect the turbine drill 10 by varying the pressure on the individual clam shells 48 through clam shell hydraulic piston actuators 53. For example, by increasing the pressure on two clam shells 48, 180° from the opposite pair of clam shells, the cutter head 14 would be axially redirected away from the clam shells with the greater pressure.

It would be obvious to use more or less stages within the turbine 34 and it would additionally be obvious to use different gear ratios within the gearbox 32 as well as the possible elimination of the gearbox wherein the turbine directly drives the cutter head 14.

It would additionally be obvious to replace the threaded shaft 40 with a reversable hydraulically actuated shaft between cylindrical case 38 and the base 31 of turbine 34.

In deep well drilling it is recognized that there will be a tremendous pressure gradient subjecting the self-propelled turbine drill 10 to a severe environment and the self-contained units would have to be pressure compensated when the well reaches extreme depths.

It will, of course, be realized that various modifications can be made in the design and operation of the present invention without departing from the spirit thereof. Thus, while the principle, preferred construction, and mode of operation of the invention have been explained and what is now considered to represent its best embodiment has been illustrated and described, it should be understood that within the scope of the appended claims the invention may be practiced otherwise than as specifically illustrated and described.

I claim:

1. A self-propelled turbine drill apparatus for drilling well holes comprising:

means clamping a first cylindrical end against a well casing wall, said first cylindrical end making up part of said turbine drill having clamping means therein, said first end being operably connected to and opposite to a second cylindrical end containing a cutter head assembly, said first and second ends being axially movable one from the other, means driving said cutter head assembly at said second end deeper into said well hole by extending said cutter head assembly axially from said clamped first cylindrical end, means clamping said cutter head assembly at said second cylindrical end near the end of said well hole when said cutter head assembly is advanced axially into said hole its maximum length, said means clamping said cutter head assembly is an underreamer section affixed to and axially in line with a base of said cutter head assembly, said underreamer section having expandable cutter arms equidistantly spaced around said underreamer section, said cutter arms expand out against said casing wall, thereby clamping said cutter head assembly near the bottom of the hold, means releasing said clamped first cylindrical end, means retracting said released first cylindrical end toward said cutter head assembly, and subsequently reclamping said first cylindrical end thereby initiating a subsequent turbine drill cycle thereby advancing said drill deeper into said hole after said cutter arms have been retracted in said underreamer section.

2. The invention as set forth in claim 1 wherein said means driving said cutter head assembly at said second cylindrical end deeper into said well hole is a hydraulically reversible cylindrical rod that extends from within said first cylindrical end, said reversible rod being connected to a base of said cutter head assembly at said second cylindrical end, said rod being hydraulically actuatable at said first end to translate said cutter head assembly away from or towards said means clamping said first cylindrical end against said casing wall.

3. The invention as set forth in claim 1 wherein said means driving said cutter head assembly at said second cylindrical end deeper into said well hole is a drive screw which axially extends from within said first cylindrical end, said drive screw being connected at a second end to a base of said cutter head assembly at said second cylindrical end said drive screw being actuatable by a reversible motor assembly.

4. The invention as set forth in claim 3 wherein said motor driving said drive screw is a reversable hydraulic motor.

5. The invention as set forth in claim 4 wherein said motor driving said drive screw is a reversable electric motor.

6. The invention as set forth in claim 1 wherein said cutter head assembly comprises a four-stage hydraulic turbine positioned adjacent to said first cylindrical end clamping means, immediately downstream of said four-stage turbine is positioned a speed reduction gearbox coupled to said turbine, a thrust bearing housing is positioned downstream from said speed reduction gearbox, said thrust bearing housing being coupled to said underreamer section which is placed between the thrust bearing housing and the cutter head at said second end.

7. The invention as set forth in claim 6 wherein the gear reduction of said speed reduction gearbox is 30:1.

8. The invention as set forth in claim 7 wherein there are four clam shells equidistantly spaced around said first cylindrical end, said clam shells being actuatable by at least four hydraulic pistons, said pistons being reversible to retract said clam shells against said first cylindrical end, said turbine drill apparatus may be redirected in said well hole by varying the pressure in one or more of said reversible hydraulic pistons connected to said four clam shells.

* * * * *